US011067375B1

(12) United States Patent
Helgason

(10) Patent No.: US 11,067,375 B1
(45) Date of Patent: Jul. 20, 2021

(54) ADJUSTABLE CASE RESIZING

(71) Applicant: Dean E. Helgason, Tucson, AZ (US)

(72) Inventor: Dean E. Helgason, Tucson, AZ (US)

( * ) Notice: Subject to any disclaimer, the term of this patent is extended or adjusted under 35 U.S.C. 154(b) by 0 days.

(21) Appl. No.: 16/985,035

(22) Filed: Aug. 4, 2020

Related U.S. Application Data

(60) Provisional application No. 62/886,141, filed on Aug. 13, 2019.

(51) Int. Cl.
*F42B 33/10* (2006.01)
*B21D 51/16* (2006.01)

(52) U.S. Cl.
CPC ..... *F42B 33/10* (2013.01); *B21D 51/16* (2013.01)

(58) Field of Classification Search
CPC ..... F42B 33/10; B21D 51/16
See application file for complete search history.

(56) References Cited

U.S. PATENT DOCUMENTS

| | | | | |
|---|---|---|---|---|
| 4,890,534 | A * | 1/1990 | Bender | F42B 33/14 102/511 |
| 5,221,806 | A * | 6/1993 | Chaney | F42B 33/04 86/19 |
| 5,635,661 | A * | 6/1997 | Tuftee | F42B 33/10 86/24 |
| 6,397,720 | B1 * | 6/2002 | Fox | F42B 33/10 86/23 |
| 9,696,124 | B2 * | 7/2017 | Keska | F42B 33/10 |
| 10,076,781 | B1 * | 9/2018 | Lee | F42B 33/004 |
| 2012/0160081 | A1 * | 6/2012 | Beebe | F42B 33/10 86/24 |

* cited by examiner

*Primary Examiner* — Joshua T Semick
(74) *Attorney, Agent, or Firm* — Hayes Soloway P.C.

(57) ABSTRACT

An adjustable case sizing die includes a die body having a threaded outer surface and a threaded inner surface. The threaded outer surface of the die body has a first pitch. The threaded inner surface of the die body has a second pitch smaller than the first pitch. A sizing insert is positionable within an interior cavity of the die body. An adjusting spindle is connected to a top of the sizing insert. The adjusting spindle has a threaded outer surface. The threaded outer surface of the adjusting spindle has the same pitch as the inner surface of the die body. The adjusting spindle is threadably insertable into the die body. Turning the adjusting spindle within the die body changes a height of the sizing insert within the die body.

20 Claims, 6 Drawing Sheets

ADJUSTABLE CASE RESIZING

CROSS REFERENCE TO RELATED APPLICATIONS

This application claims benefit of U.S. Provisional Application Ser. No. 62/886,141 entitled, "Adjustable Case Resizing" filed Aug. 13, 2019, the entire disclosure of which is incorporated herein by reference.

FIELD OF THE DISCLOSURE

The present disclosure is generally related to firearm cartridge case resizing and more particularly is related to adjustable firearm case resizing.

BACKGROUND OF THE DISCLOSURE

When a cartridges fired in a firearm, the burning powder inside the case creates pressure, which pushes the bullet into the barrel of the firearm and out toward a target. The pressure inside the case also causes the case to expand, changing the dimensions of the case. Users who reload their ammunition using these cases must resize them to the dimensions specified by the case manufacturer according to industry standards. Improper sizing of the reloaded cases can lead to a number of issues when firing. For instance, a case that is too long may cause the cartridge to not fit properly in the chamber, causing the firearm to jam or preventing the cartridge from firing. A case with too much internal volume may result in reduced pressure on the projectile, decreasing speed, distance, and accuracy. A case that is too short may not sit snugly in the chamber and may cause damage to the case itself or to the firearm.

Case resizing is most commonly performed using a sizing die. The sizing die is formed and shaped to accommodate a particular type and caliber of case. The sizing die is threaded into a threaded hole in a press, and the case is pressed into the sizing die. The relative height of the sizing die in the press may be adjusted by turning the entire die body in the press. It is important to locate the sizing die at the correct height in order to ensure proper dimensioning of the case. In practice, the correct height is often found by adjusting the sizing die incrementally a number of times; the user typically starts with the die adjusted too high, then adjusts the die into the press until the case has reached the correct size.

However, there are a number of issues with this method. First, it can be cumbersome to adjust the relative height of the sizing die in the press. For example, adjusting the relative height of the sizing die may include the steps of loosening the die lock nut set screw; loosening the lock nut that secures the die body to the reloading press; turning the die within the press; tightening the die lock nut; sizing the case; checking the case dimensions, loosening the die lock nut; turning the die lock nut again to a shorter height, tightening the die lock nut; sizing and checking the case again; and so on. Second, it can be difficult to access the lock nut and set screw when the sizing die is located in the press. The location of the set screw is dependent on the relative orientation of the lock nut, and may at times be located away from the user's position. For example, if the user is using a rotating turret press to perform multiple reloading operations in sequence, the dies in the turret press will be located close together along a circular or semi-circular perimeter. Depending on the orientation of each die's lock nut, the set screws may be oriented adjacent to another lock nut or at the interior of the circle or semi-circle, making it difficult to access without special, angled tools. This may add to the time and effort required to iteratively adjust the sizing die to an appropriate height. Third, the adjustment available on typical presses is not highly accurate. The threads that connect the sizing die and the press are typically a coarse thread pitch of 14 threads per inch. This causes the sizing die to move vertically approximately 0.071 inches with one full turn of the die. A typical case may only need to be shortened by a few thousandths of an inch to achieve the correct dimensioning. Thus, the coarse adjustment available with a typical press and sizing die combination may not allow a user to accurately size the case to within a desired tolerance. For marksmen or other shooters who desire precision and reliability, it may be difficult to achieve using ammunition cases resized in this manner.

Thus, a heretofore unaddressed need exists in the industry to address the aforementioned deficiencies and inadequacies.

SUMMARY OF THE DISCLOSURE

Embodiments of the present disclosure provide a die apparatus for case sizing. Briefly described, in architecture, one embodiment of the apparatus, among others, can be implemented as follows. An adjustable case sizing die includes a die body having a threaded outer surface and a threaded inner surface. The threaded outer surface of the die body has a first pitch. The threaded inner surface of the die body has a second pitch smaller than the first pitch. A sizing insert is positionable within an interior cavity of the die body. An adjusting spindle is connected to a top of the sizing insert. The adjusting spindle has a threaded outer surface. The threaded outer surface of the adjusting spindle has the same pitch as the inner surface of the die body. The adjusting spindle is threadably insertable into the die body. Turning the adjusting spindle within the die body changes a height of the sizing insert within the die body.

The present disclosure can also be viewed as providing methods of sizing a case. In this regard, one embodiment of such a method, among others, can be broadly summarized by the following steps: providing a reloading press having at least one station for accepting a die body; threadably inserting at least one die body into the reloading press, the die body having a threaded outer surface and a threaded inner surface, the threaded outer surface of the die body having a first pitch, and the threaded inner surface of the die body having a second pitch smaller than the first pitch; threadably inserting an adjusting spindle into the at least one die body, the adjusting spindle having a threaded outer surface having the same pitch as the inner surface of the die body, wherein the adjusting spindle is connected to a top of a sizing insert, and wherein the sizing insert is positionable within an interior cavity of the die body; turning the adjusting spindle within the die body to change a height of the sizing insert within the die body, thereby sizing the height of the interior cavity to a case height specification; and pressing a case into the sizing insert, thereby sizing the case to the case height specification.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
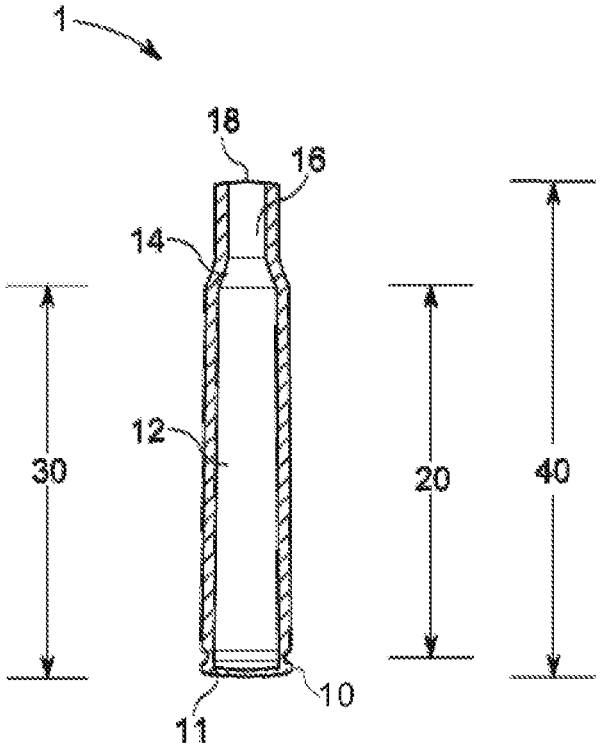
FIG. 1 (PRIOR ART)
FIG. 1 is a cross-sectional illustration of a prior art rifle case.

FIG. 1 is a cross-sectional illustration of a prior art rifle case 1. The case 1 may include a body 12 having a shoulder 14, neck 16, case head 11, and rim 10. The body 12 may be cylindrical, having parallel walls. The rim 10 may be located at the case head 11, which is the base of the body 12. The shoulder 14 may be angled toward the center of the body 12, causing the parallel walls of the neck 16 to have a smaller circumference than the body 12. In use, the case head 11 may include an open space for holding a primer (not shown), and the interior of the body 12 may hold an amount of powder (not shown). A projectile (not shown) may be placed partially within the neck 16 and may extend above the top 18 of the case 1. When the firing pin or hammer of a firearm strikes the primer in the case head 11, it ignites the powder, causing pressure to build in the body 12, and subsequently causing the projectile to be propelled forward. The pressure that builds inside of the body 12 may cause the body 12, shoulder 14, and neck 16 to expand or otherwise deform. A case 1 may be one component of a rifle or pistol cartridge. A rifle or pistol cartridge may include, in an assembled state, a case 1, primer, powder, and projectile.

A user wanting to reload a case 1 may be concerned with a number of dimensions of the case 1. For instance, the case size 20 may be measured as the length of the body 12 not including the rim 10 or the shoulder 14. The rim 10 or case head 11 to datum point size 30 may be measured as the length of the body 12 and the rim 10. In some examples, this measurement does not include the length of the shoulder 14. In other examples, this measurement may include a portion or all of the shoulder 14. This may depend on the firearm manufacturer's specifications. The overall length 40 may be measured as the length of the neck 16, shoulder 14, body 12, and rim 10. The overall length 40 may be important in determining how well the case 1 sits within a firearm's chamber.

Figure 2:
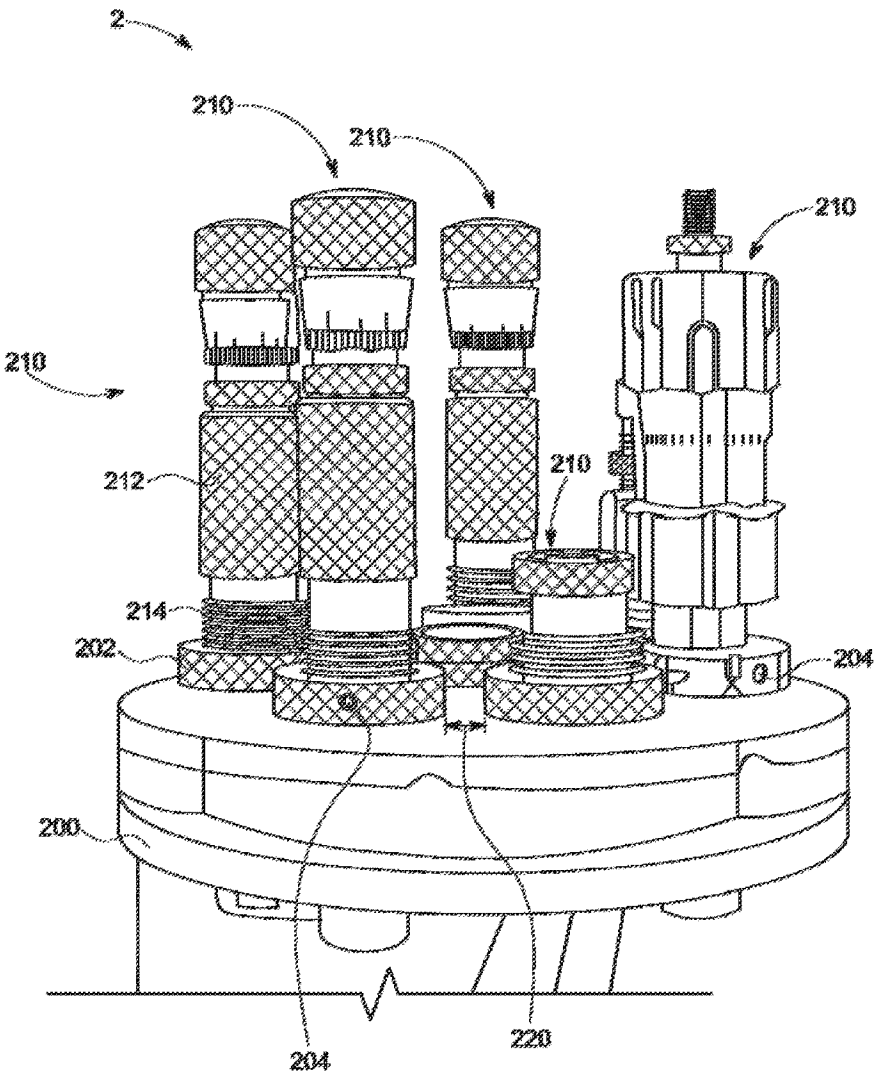
FIG. 2 (PRIOR ART)
FIG. 2 is a diagrammatic illustration of a prior art turret press for reloading ammunition.

FIG. 2 is a diagrammatic illustration of a prior art turret press 2 for reloading ammunition. The turret press 2 may include a base 200 with a plurality of holes for holding dies 210 in a circular or semi-circular configuration. The holes may be threaded to accept the threaded portion 214 of the dies 210 within the holes. Each die 210 may have a lock nut 202 that may be tightened around the threaded portion 214 once the die body 212 is set at a desired location. The lock nut 202 may be threaded around the threaded portion 214 of the die 210 and may be twisted to contact the base 200 of the turret press 2 to prevent the die 210 from turning further within the base 200. The lock nut 202 may be fastened in place by a set screw 204 located on a side of the lock nut 202. The set screw 204 may be tightened against the threaded portion 214 of the die 210 to lock each of the components firmly in place. Generally, the set screw 204 may be adjusted using a screw driver or hex key wrench.

The threaded portion 214 of each die 210 may have a pitch determining the amount of vertical adjustment the die 210 receives for each turn. A typical die 210 may have a pitch of about ⅞-14, which results in the die 210 moving about 0.071 inches per turn of the die body 212. It may be difficult for a user to achieve a more precise adjustment, particularly on the order of a few thousandths of an inch, using this pitch. Users may visually estimate half, quarter, or smaller turns of the die 210, which may still provide a precision that is an order of magnitude larger than the adjustment precision required.

As FIG. 2 shows, a plurality of dies 210 may be located around the base 200 of the turret press 2 in close proximity to one another. The space 220 between the dies 210 may be just a fraction of an inch in some cases. The set screw 204 located on each lock ring 202 may be at any angular position around the lock nut 202, depending on the relative height of the die 210. In one example, the set screw 204 may be located in the space 220 between the dies 210. In another example, the set screw 204 may be located toward the interior of the turret press 2. It may be difficult for a user to adjust a set screw 204 located between the dies 210 or toward the interior of the turret press 2, as screw drivers and hex key wrenches may not be shaped to reach those close spaces. Thus, it can be difficult to accurately lock and adjust dies 210 in the turret press 2 configurations shown in FIG. 2.

Figure 3:
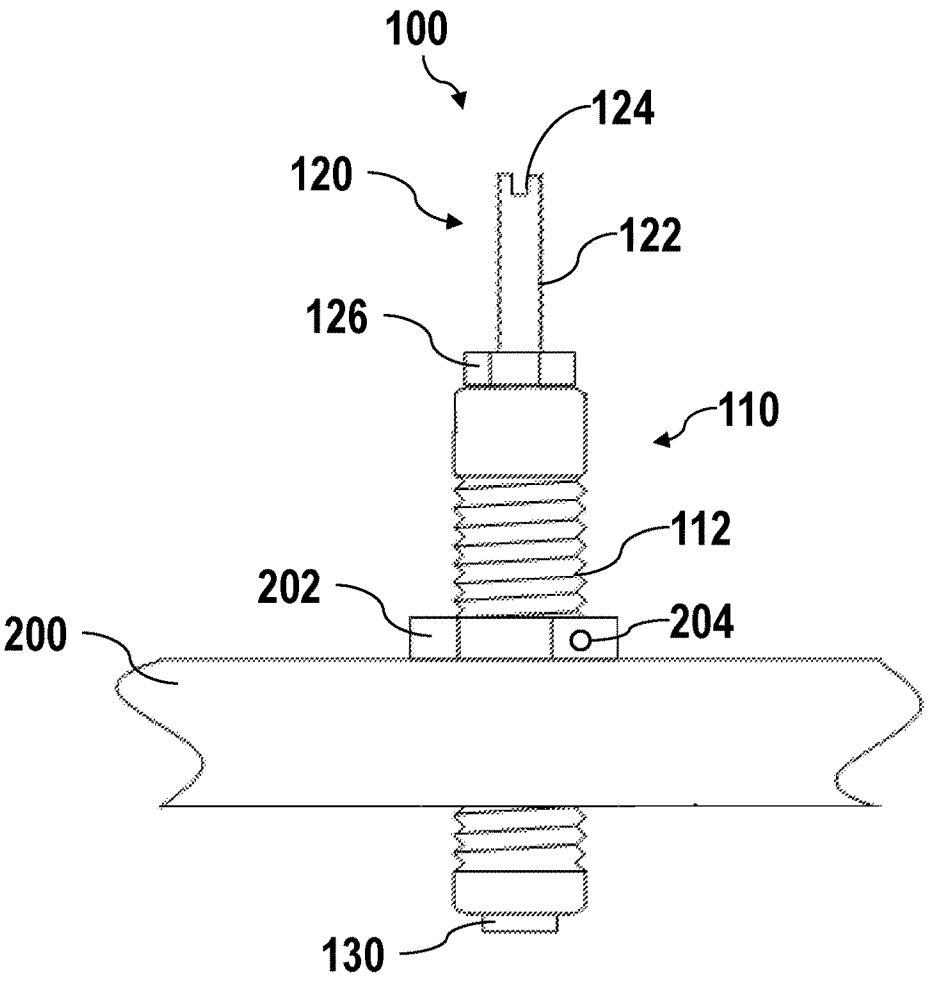
FIG. 3 is a cross-sectional illustration of an adjustable case sizing die, in accordance with a first exemplary embodiment of the present disclosure.

FIG. 3 is a cross-sectional illustration of an adjustable case sizing die 100, in accordance with a first exemplary embodiment of the present disclosure. The adjustable case sizing die 100 includes a die body 110 having a threaded outer surface 112 and a threaded inner surface (shown in FIG. 4A). The threaded outer surface 112 of the die body 110 has a first pitch. The threaded inner surface of the die body 110 has a second pitch smaller than the first pitch. A sizing insert 130 is positionable within an interior cavity of the die body 110. An adjusting spindle 120 is connected to a top of the sizing insert 130. The adjusting spindle 120 has a threaded outer surface 122. The threaded outer surface 122 of the adjusting spindle 120 has the same pitch as the inner surface (shown in FIG. 4A) of the die body 110. The adjusting spindle 120 is threadably insertable into the die body 110. Turning the adjusting spindle 120 within the die body 110 changes a height of the sizing insert within the die body 110.

The die body 110 may be a rifle or pistol case sizing die. The die body 110 may be sized and shaped to suit any desired caliber and manufacturer of ammunition. The die body 110 may be cylindrical and sized to fit into any press commonly used in reloading operations. The threaded outer surface 112 may be sized to create a mechanical fit with the threaded portion of a reloading press. The threaded outer surface 112 may have a pitch of about ⅞-14, providing a 0.071-inch adjustment with each full turn. The pitch of the threaded outer surface 112 may be greater than the pitch of the threaded inner surface, i.e., the threaded outer surface 112 may provide a greater vertical displacement per turn than the threaded inner surface. The threaded inner surface is discussed in greater detail in FIGS. 4A and 4B, below.

The threaded outer surface 112 may extend along an exterior portion of the die body 110. In one example, the threaded outer surface 112 may extend along a majority of the die body 110. In a particular example, the threaded outer surface 112 may extend along substantially all of the die body 110. This may allow the die body 110 to be secured along a wide range of vertical positions, which may allow the die body 110 to operate with cases of various sizes. In another example, the threaded outer surface 112 may extend along substantially all of a lower portion of the die body 110.

The die body 110 may be threaded into a hole in the base 200 of a press, such as a turret press or a single-stage press. The die body 110 may be twisted until the die body 110 roughly reaches a desired height, then a lock nut 202 may be twisted to lock the die body 110 in place. When the lock nut 202 is tightened, the die body 110 may be vertically fixed. The lock nut 202 may include a set screw 204 located on an exterior side of the lock nut 202.

In one example, the die body 110 may be made from a hard metal, such as steel or carbide.

The sizing insert 130 may be an insert having a shape corresponding to a particular caliber of cartridge. The sizing insert 130 may be positionable within the die body 110. In one example, a portion of the sizing insert 130 may extend below the die body 110. The sizing insert 130 may be formed from a hard metal, such as steel or carbide. The sizing insert 130 is discussed in greater detail in FIG. 4B, below.

The adjusting spindle 120 may be a rod formed from a hard metal, such as steel or carbide. In one example, the adjusting spindle 120 may be a solid rod. The adjusting spindle 120 may have a length sufficient to properly size a case and allow a user to manipulate the position of the adjusting spindle 120. The adjusting spindle 120 has a threaded outer surface 122. The threaded outer surface 122 of the adjusting spindle 120 has the same pitch as the inner surface of the die body 110. The threaded outer surface 122 of the adjusting spindle 120 may extend along a portion of the adjusting spindle 120. In one example, the threaded outer surface 122 may extend along substantially all of the length of the adjusting spindle 120. The adjusting spindle 120 may be positioned by turning by hand or by tool. In one example, the adjusting spindle 120 may include at least one groove 124 to allow a screwdriver or other tool to turn the adjusting spindle 120. The at least one groove 124 may be located on a top surface of the adjusting spindle 120. In one example, the at least one groove 124 may be shaped to accommodate a flat head, Phillips head, pozidriv, torx, security T, hexagon-shaped, or any other shape of screwdriver.

The adjusting spindle 120 is threadably insertable into the die body 110. Turning the adjusting spindle 120 within the die body 110 changes a height of the sizing insert 130 within the die body 110. This is discussed in greater detail below. The adjusting spindle 120 may include a spindle lock nut 126. The spindle lock nut 126 may have a threaded interior surface to allow it to fit around the adjusting spindle 120. The spindle lock nut 126 may be turnable about the adjusting spindle 120 to lock the position of the adjusting spindle 120 and prevent vertical motion once it has been adjusted to a desired height.

Figure 4B:
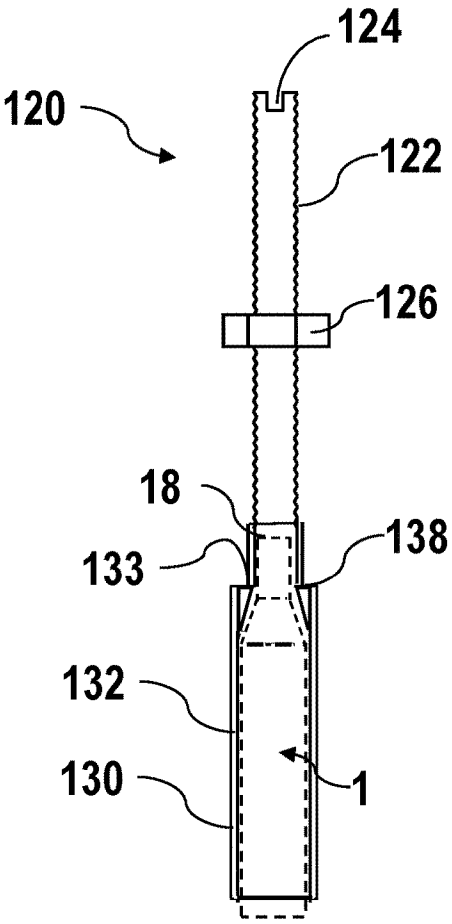
FIG. 4B is a cross-sectional illustration of the sizing insert and adjusting spindle, in accordance with the first exemplary embodiment of the present disclosure.
Figure 4A:
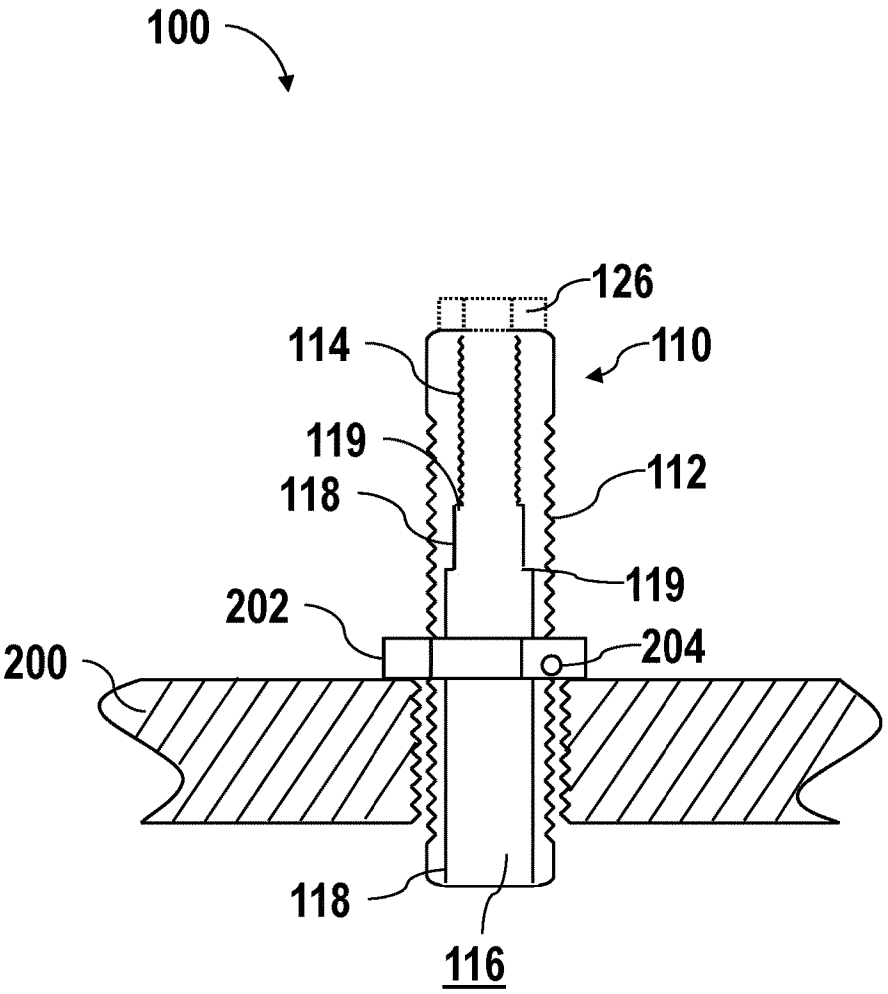
FIG. 4A is a cross-sectional illustration of the interior of the adjustable case sizing die of FIG. 3, in accordance with the first exemplary embodiment of the present disclosure.

FIG. 4A is a cross-sectional illustration of the interior of the adjustable case sizing die 100 of FIG. 3, in accordance with the first exemplary embodiment of the present disclosure. The die 100 may include a die body 110 having a threaded outer surface 112 and a threaded inner surface 114. The threaded outer surface 112 may be threaded into the base 200 of a reloading press and locked with a lock nut 202 and set screw 204.

The threaded inner surface 114 may be located on an interior cavity 116 of the die body 110. The interior cavity 116 may extend through the entire length of the die body 110 in order to allow the insertion of both the adjustable sizing insert and a case 1 from below and an adjusting spindle 120 from above the die body 110. The interior cavity 116 may include side walls 118 extending through the interior cavity 116. In one example, the side walls 118 may form a substantially cylindrical interior cavity 116 having a stepped, reduced interior diameter. At one or more points along the die body 110, the side walls 118 may form one or more horizontal steps 119 toward the center of the die body 110 and may extend vertically again at a smaller diameter. This may allow the sizing insert to fit within the die body 110 at a maximum vertical height. In the example shown in FIG. 4A, the die body 110 has two steps 119 resulting in sidewalls 118 having three decreasing diameters. The steps 119 may allow the sizing insert to sit flush against the die body 110 at a maximum height. The sizing insert may be adjusted downward, as is discussed in FIG. 4B, below.

The threaded inner surface 114 may extend along a portion of the side walls 118 of the die body 110. In one example, the threaded inner surface 114 may extend along an upper portion of the die body 110. In another example, the threaded inner surface 114 may extend vertically downward from a top of the die body 110. In another example, the threaded inner surface 114 may extend along and around at least a portion of the narrowest sidewall 118 of the interior cavity 116. In a particular example, the threaded inner surface 114 may extend along and around the entire narrowest sidewall 118 of the interior cavity 116. This may allow the adjusting spindle 120 to be inserted into the die body 110 and threaded along the threaded inner surface 114.

FIG. 4B is a cross-sectional illustration of the sizing insert 130 and adjusting spindle 120, in accordance with the first exemplary embodiment of the present disclosure. FIG. 4B may be understood with reference to FIG. 4A. The adjusting spindle 120 is shown as a cylindrical rod having a threaded outer surface 122 extending the length of the adjusting spindle 120. The pitch of the threaded outer surface 122 matches the pitch of the threaded inner surface 114 of the die body 110 shown in FIG. 4A. The adjusting spindle 120 may be threaded into the die body 110. The position of the adjusting spindle 120 may be vertically raised or lowered by turning the adjusting spindle 120. A spindle lock nut 126 may be threaded around or about the adjusting spindle 120 in order to lock the adjusting spindle 120's vertical position.

The adjusting spindle 120 may be connected to the sizing insert 130 at the top of the sizing insert 130. In one example, the sizing insert 130 and adjusting spindle 120 may be formed as a unitary piece. In another example, the sizing insert 130 and adjusting spindle 120 may be connected by welding, epoxy, or other adhesive. The sizing insert 130 may be a hollow housing shaped to size a particular caliber of cartridge case 1. The sizing insert 130 may have vertical side walls 132 having at least one diameter. A horizontal step 138 located near the top of the sizing insert 130 may extend inward toward the center of the sizing insert 130, then continue vertically to form a side wall 133 having a smaller diameter. In one example, the sidewalls 118 and steps 119 of the interior cavity 116 may be sized and shaped to substantially conform to an exterior surface of the sizing insert 130. That is, the exterior surface of the sizing insert 130 may be in substantial contact with the sidewalls 118 and steps 119 of the interior cavity 116 when the sizing insert 130 is inserted within the interior cavity 116. This may allow the sizing insert 130 and the die body 110 to maintain a secure fit in operation. The stepped shape of the sizing insert 130 may allow the sizing insert 130 to contact and reshape a case 1. The step 138 may be located at a position corresponding to the dimensions of the case 1 as shown in FIG. 1, above. For example, the step 138 may be sized to contact the case 1 where the shoulder 14 and the neck 16 meet. In another example, the step 138 may correspond to the dimensions of the case size 20 or the datum point size 30.

The vertical position of the sizing insert 130 may be adjustable by turning the adjusting spindle 120 within the die body 110. The sizing insert 130 may be positioned within the vertical cavity 116 of the die body 110 by threading the adjusting spindle 120 into the threaded inner surface 114 of the die body 110. When a case 1 is placed within the sizing insert 130, it may be pressed against the side walls and step 132, 138 shaped by the sizing insert. The adjusting spindle 120 may be adjusted downward until the side walls and step 132, 138 shape the top 18 of the case 1. The adjusting spindle 120 may be further adjusted in order to change the length of the case 1 when it is pressed into the die.

The pitch of the threaded outer surface 122 and the threaded inner surface 114 may be smaller than the pitch of the threaded outer surface 112 of the die body 110. In other words, a turn of the adjusting spindle 120 may provide a finer, more precise vertical adjustment than the same turn of the die body 110 in the base 200. In one example, the pitch of the threaded outer surface 122 and threaded inner surface 114 may be as fine as 40 to 50 threads per inch, which may provide a vertical adjustment finer than 0.025 inches per turn. In one example, the pitch of the threaded outer surface 122 and threaded inner surface 114 may be finer than 50 threads per inch. In another example, the pitch of the threaded outer surface 122 and threaded inner surface 114 may be more coarse than 50 threads per inch.

Figure 4C:
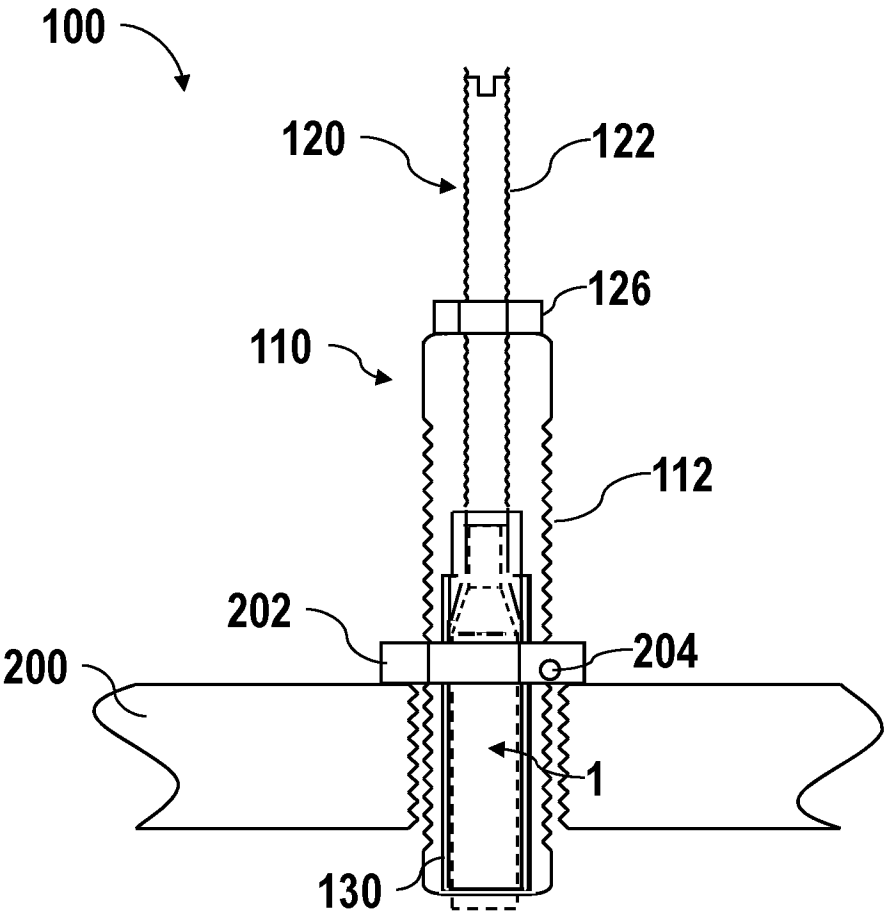
FIG. 4C is a cross-sectional illustration showing the adjustable case sizing die in use with a case.

FIG. 4C is a cross-sectional illustration showing the adjustable case sizing die 100 in use with a case 1. FIG. 4C may be understood with reference to FIGS. 4A-4B. In operation, the sizing insert 130 and adjusting spindle 120 may be threaded into the die body 110. The die body 110 may be threaded into the base 200 of the reloading press. The ram of the press may be raised to its highest point, and the die body 110 may be turned until it sits low enough to contact the top of the ram or a shell holder attached to the ram. In one example where a portion of the sizing insert 130 extends below the die body 110, the sizing insert 130 may contact the top of the ram or the shell holder attached to the ram. The die body 110 may be secured in position by tightening the lock nut 202 and fastening the set screw 204.

The case 1 may be placed in the reloading press and may be raised into the die body 110 and sizing insert 130 by the press ram. In one example, the case 1 may be a rifle or a pistol case. The internal side walls 132 of the sizing insert 130 may press against the case 1, causing the case 1 to be reduced to the appropriate size. As the press ram raises the case 1 to the highest point, the top of the case 1 may contact the step 138 of the sizing insert 130. If the case 1 is too long, the sizing insert 130 may press against the case 1 until it has been shortened by the force of the sizing insert 130. The user may measure the length of the case 1—the case size, datum point size, overall length, or some combination thereof—to determine if the case 1 has been appropriately sized. If the case 1 remains too long, the user may turn the adjusting spindle 120 an amount corresponding to the pitch of the threaded outer surface 122 and the excess length. This may adjust the height of the sizing insert 130 lower into the die body 110, reducing the height of the interior cavity 116. The user may place another case 1 in the press and perform the sizing again, adjusting the position of the adjusting spindle 120 and sizing insert 130 until the case 1 has achieved the desired length. Once the desired length has been achieved, the user may lock the position of the adjusting spindle 120 using the lock nut 126. If the case 1 measures too short, the user may adjust the sizing insert 130 upwardly out of the die body 110 in order to create more vertical space within the die body 110. The user may repeat the sizing process on another case 1 and may adjust the height of the sizing insert 130 until the cases 1 measure the desired length.

This operation differs considerably from the prior art operation in a number of ways. First, the user is not required to iteratively adjust the position of the die body 110 in the base 200 by turning the die body 110, lock nut 202, and set screw 204. The die body 110, lock nut 202, and set screw 204 remain fixed in the base 200 of the press. This improves the ease and time required of the operation. Further, the user is not required to adjust a set screw 204 that may be positioned at any angle around the lock nut 202. The adjusting spindle 120 allows the user to access it from the top of the die 100, improving the ease of access without requiring specialized tools. Further still, the adjustments made according to the pitch of the threaded outer surface 122 of the adjusting spindle 120 provide considerably higher precision than the adjustments that can be made by according to the pitch of the threaded outer surface 112 of the die body 110. This may allow the user to find the proper adjustment height with fewer iterations of the process, as well as providing increased precision in sizing results. Further still, the sizing insert 130 and adjusting spindle 120 may be removed and replaced with a sizing insert 130 and adjusting spindle 120 sized for a different caliber. This may be done without removing the die body 110 and without the need to reposition the die body 110.

Figure 5:
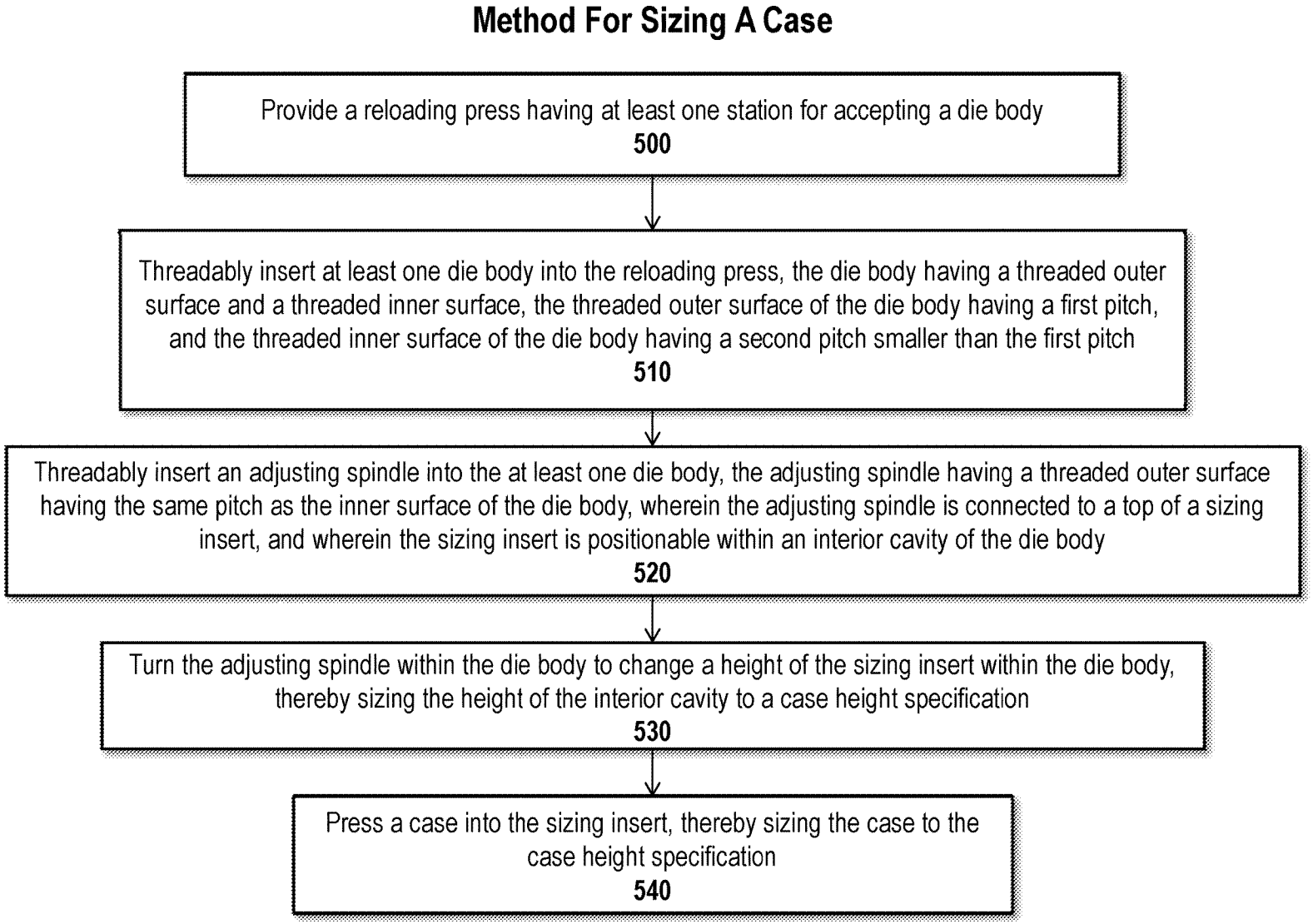
FIG. 5 is a flowchart illustrating a method of sizing a case, in accordance with the first exemplary embodiment of the present disclosure.

FIG. 5 is a flowchart illustrating a method of sizing a case, in accordance with the first exemplary embodiment of the present disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

Step 500 includes providing a reloading press having at least one station for accepting a die body. The reloading press may be any suitable reloading press, including a turret press. In one example, the turret press may have a plurality of holes, for instance, four or more, for accepting reloading dies.

Step 510 includes threadably inserting at least one die body into the reloading press, the die body having a threaded outer surface and a threaded inner surface, the threaded outer surface of the die body having a first pitch, and the threaded inner surface of the die body having a second pitch smaller than the first pitch. The die body may be a sizing die for sizing the case size, datum point size, or overall length of the case. The die body may be the one described in FIGS. 3-4C, above. In one example, there may be one or more additional dies inserted into the reloading press. For instance, additional dies may operate to adjust the neck sizing, overall length, priming, powdering, and loading the projectile. The additional dies may be inserted into the reloading press at close proximity to the at least one die body.

Step 520 includes threadably inserting an adjusting spindle into the at least one die body, the adjusting spindle having a threaded outer surface having the same pitch as the inner surface of the die body, wherein the adjusting spindle is connected to a top of a sizing insert, and wherein the sizing insert is positionable within an interior cavity of the die body. The adjusting spindle may be a rod sized to fit within the die body. The adjusting spindle may have a length corresponding to a portion of the length of the die body. In one example, the adjusting spindle may be inserted into the die body from below the die body. The adjusting spindle may be raised until the sizing insert contacts interior side walls of the die body. In operation, a lower portion of the adjusting spindle may extend into the die body, while an upper portion of the adjusting spindle extends above the die body. The threaded outer surface of the adjusting spindle may allow the adjusting spindle to mate with the threaded inner surface of the die body to form a threaded connection.

The sizing insert may be the sizing insert described relative to FIGS. 3-4C, above. The sizing insert may be sized and shaped to size a case inserted into the sizing insert.

Step 530 includes turning the adjusting spindle within the die body to change a height of the sizing insert within the die body, thereby sizing the height of the interior cavity to a case height specification. The adjusting spindle may be turned by hand or by tool. In one example, the adjusting spindle may be turned by inserting a screwdriver or other tool into a groove located on a top surface of the adjusting spindle. In operation, the sizing insert may be adjusted lower within the die body; the sizing insert may start at a maximum vertical height, in a position against the steps of the die body, and may be turned lower into the interior cavity of the die body. As the adjusting spindle is turned, the sizing insert may be lowered into the interior cavity of the die body, changing the height of the interior cavity. For instance, when the adjusting spindle is lowered, the height of the interior cavity may be reduced. The adjusting spindle may be turned to adjust the height of the sizing insert to correspond with a case height or datum specification. The case height or datum specification may be determined by a manufacturer, guide, or other source, including the user's own preference. In one example, the case height specification may be customized to a user's firearm in order to achieve a specific fit.

After the sizing insert has been adjusted to a desired height, a lock nut on the adjusting spindle may be tightened against the die body in order to lock the position of the adjusting spindle within the die body. The lock nut may be loosened when further adjustment is needed.

Step 540 includes pressing a case into the die body, thereby sizing the case to the case height or datum specification. In operation, the case may be lubricated before being pressed to ensure that the case is smoothly released from the sizing insert. Upon pressing the case into the die body, the case may be directed through the sizing insert and into an interior cavity of the die body. The interior cavity may be sized and shaped by the sizing insert to allow the case to be pressed upward into the die body. The interior cavity may be defined by vertical side walls and steps of the sizing insert. The steps may delineate portions of the sizing insert having decreasing circumferences. The shape of the sizing insert may correspond to the desired shape of the case.

When the case is pressed into the sizing insert and die body, the case may be reshaped by the force of the press against the case. One or more dimensions of the case may be adjusted, including the case size, datum point size, overall length, shoulder length, and neck length.

In one example, the case may be measured after it has been sized. If the case has not been sized back to the desired dimensions, steps 530 and 540 may be repeated one or more times. For example, if the case remains too long, a user may remove the case from the sizing insert, loosen the lock nut on the adjusting spindle, adjust the adjusting spindle and sizing insert lower into the interior cavity, lock the lock nut, and press the case again. The user may measure the newly-pressed case and may continue to adjust the height of the adjustment spindle until the desired dimensions have been achieved.

The method may further include any other features, components, or functions disclosed relative to any other figure of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An adjustable case sizing die, comprising:

a die body having a threaded outer surface and a threaded inner surface, the threaded outer surface of the die body having a first pitch, and the threaded inner surface of the die body having a second pitch smaller than the first pitch;

a sizing insert removably positionable within an interior cavity of the die body and shaped to correspond to an exterior dimension of a case; and an adjusting spindle having a lower end joined to a top portion of the sizing insert, the adjusting spindle having a threaded outer surface of the same pitch as the inner surface of the die body, wherein the adjusting spindle is threadably insertable into the die body, and wherein turning the adjusting spindle within the die body moves the sizing insert within the die body to change a height of the sizing insert within the die body.

2. The adjustable case sizing die of claim 1, wherein the sizing insert extends below the die body.

3. The adjustable case sizing die of claim 1, wherein the sizing insert is shaped to resize a rifle or pistol case.

4. The adjustable case sizing die of claim 1, wherein the adjusting spindle further comprises at least one groove on a top surface of the adjusting spindle.

5. The adjustable case sizing die of claim 1, wherein the interior cavity of the die body comprises at least one vertical sidewall and at least one horizontal step.

6. The adjustable case sizing die of claim 5, wherein the interior cavity is shaped to substantially conform to an exterior surface of the sizing insert.

7. The adjustable case sizing die of claim 1, wherein the threaded inner surface extends along and around a narrowest sidewall of the interior cavity.

8. The adjustable case sizing die of claim 1, wherein the second pitch is between 40 and 50 threads per inch.

9. The adjustable case sizing die of claim 1, wherein the second pitch is finer than 50 threads per inch.

10. The adjustable case sizing die of claim 1, wherein the lower end of the adjusting spindle does not extend into an interior cavity of the sizing insert.

11. The adjustable case sizing die of claim 1, wherein a circumference of the adjusting spindle is constant along a length of the adjusting spindle.

12. The adjustable case sizing die of claim 1, wherein the sizing insert and the adjusting spindle are formed as a unitary piece.

13. The adjustable case sizing die of claim 1, wherein the sizing insert and the adjusting spindle are joined by welding, epoxy, or adhesive.

14. The adjustable case sizing die of claim 1, wherein the sizing insert is a hollow housing having an interior shape corresponding to at least a portion of a case and an exterior shape corresponding to a portion of the interior cavity of the die body.

15. The adjustable case sizing die of claim 1, wherein the die body does not engage the sizing insert to prevent downward motion of the sizing insert.

16. A method for sizing a case, comprising the steps of:

providing a reloading press having at least one station for accepting a die body;

threadably inserting at least one die body into the reloading press, the die body having a threaded outer surface and a threaded inner surface, the threaded outer surface of the die body having a first pitch, and the threaded inner surface of the die body having a second pitch smaller than the first pitch;

threadably inserting an adjusting spindle into the at least one die body, the adjusting spindle having a threaded outer surface having the same pitch as the inner surface of the die body, wherein a lower end of the adjusting spindle is joined to a top portion of a sizing insert, wherein the sizing insert is shaped to correspond to an exterior dimension of a case, and wherein the sizing insert is removably positionable within an interior cavity of the die body;

turning the adjusting spindle within the die body to move the sizing insert within the die body, thereby changing a height of the sizing insert within the die body to correspond to a case height specification; and pressing a case into the sizing insert, thereby sizing the case to the case height specification.

17. The method of claim 16, wherein the adjusting spindle is threadably inserted into the at least one die body from below the at least one die body.

18. The method of claim 16, wherein the sizing insert is positioned at an initial vertical position within the die body, and wherein the adjusting spindle is turned to move the sizing insert to a lower, subsequent vertical position within the die body.

19. The method of claim 16, wherein the step of pressing a case into the sizing insert sizes only a length dimension of the case.

20. The method of claim 19, wherein the length dimension is at least one from the set of: case size, datum point size, overall length, shoulder length, and neck length.

* * * * *